United States Patent [19]

Tyler

[11] 4,101,997

[45] Jul. 25, 1978

[54] WATER SKI FOR POWER DRIVEN WATER VEHICLE

[75] Inventor: Nelson Tyler, Van Nuys, Calif.

[73] Assignee: Still Water Properties, N.V., Curacao, Netherlands Antilles

[21] Appl. No.: 812,780

[22] Filed: Jul. 5, 1977

Related U.S. Application Data

[63] Continuation of Ser. No. 682,140, Apr. 30, 1976, abandoned.

[51] Int. Cl.[2] ..... A63C 15/00

[52] U.S. Cl. ..... 9/310 A; 114/288; 115/70

[58] Field of Search ..... 115/70, 39; 114/56, 114/61, 62, 283, 288–290, 292, 274; 9/310 A, 310 B, 310 C, 310 E, 310 R, 6 P

[56] References Cited

U.S. PATENT DOCUMENTS

| | | | |
|---|---|---|---|
| 3,019,755 | 2/1962 | Diamond | 114/274 |
| 3,077,617 | 2/1963 | Steffel | 9/310 A |
| 3,077,851 | 2/1963 | Bamberger | 114/62 |

*Primary Examiner*—Stephen G. Kunin
*Assistant Examiner*—Sherman D. Basinger
*Attorney, Agent, or Firm*—Fulwider, Patton, Rieber, Lee & Utech

[57] ABSTRACT

A water ski particularly adapted to function as the front ski of a twin ski, jet-driven water vehicle which is steered by turning of the front ski. Sections of the water ski define a planing surface and a pair of inclined, laterally spaced side surfaces extending downwardly and laterally of the planing surface. The portions of the side surfaces lying in or cut by a horizontal plane are equidistant from each other when the planing surface is upwardly tipped at a predetermined angle. At this angle the pair of juncture lines formed between the pair of inner surfaces and the planing surface are laterally divergent in a downstream direction when viewed from above. Reduced frontal drag results.

4 Claims, 7 Drawing Figures

FIG. 1
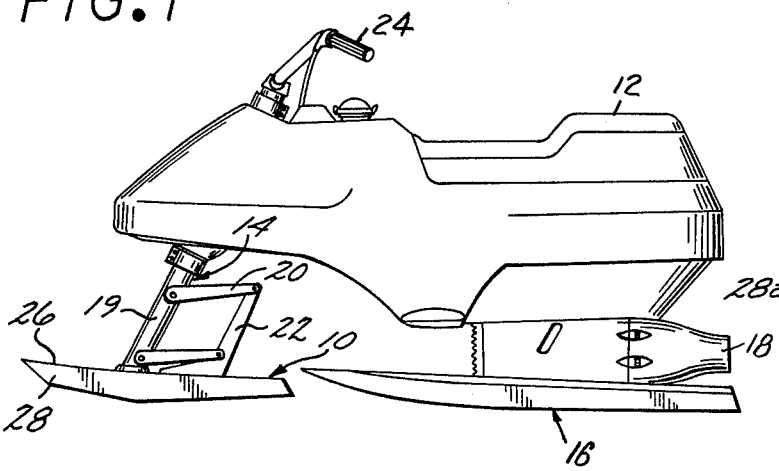
FIG. 2
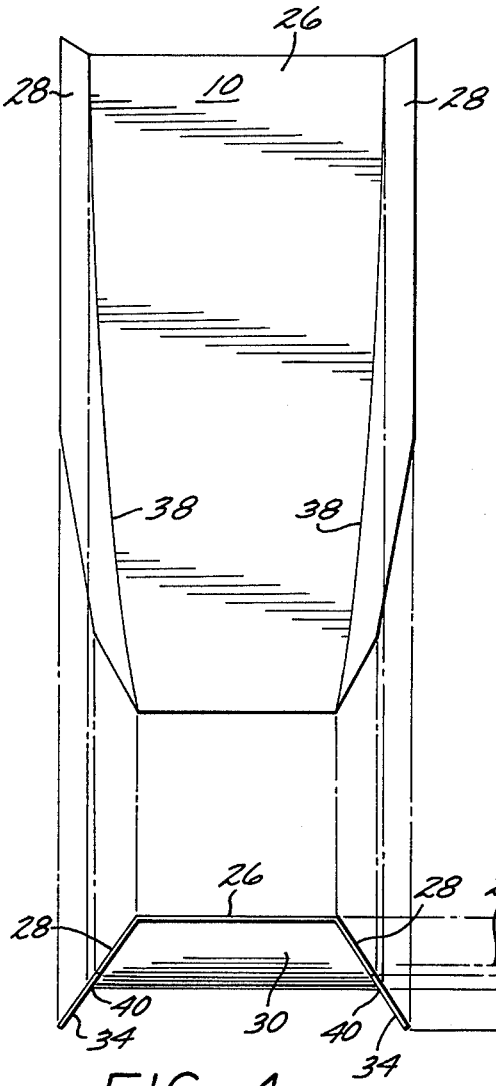
FIG. 4
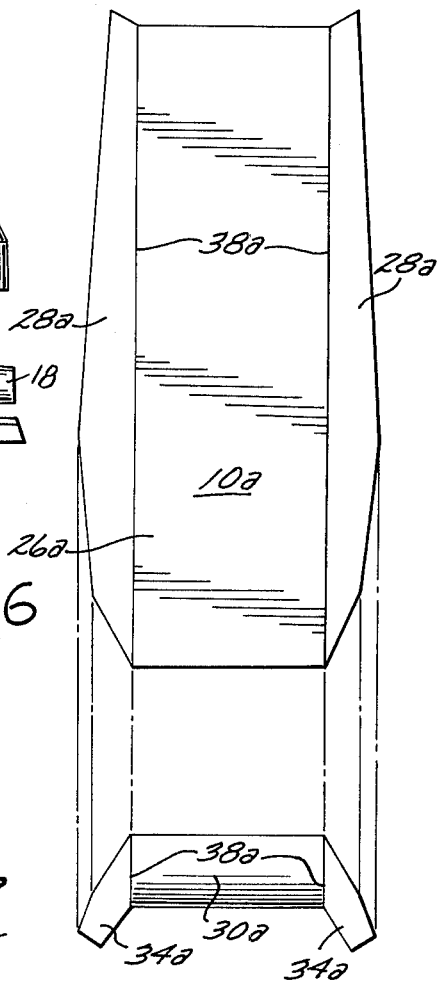
FIG. 6
PRIOR ART
FIG. 7
PRIOR ART
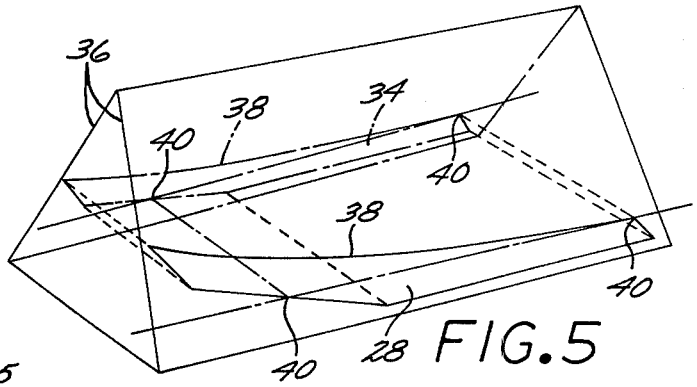
FIG. 5
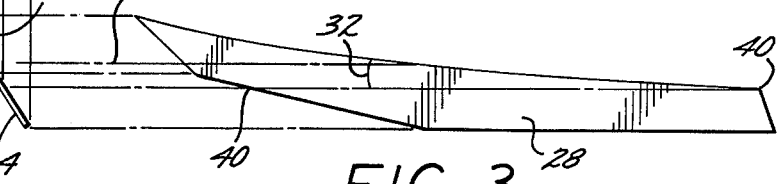
FIG. 3

WATER SKI FOR POWER DRIVEN WATER VEHICLE

CROSS-REFERENCE TO RELATED APPLICATIONS

This is a continuation of application Ser. No. 682,140, filed Apr. 30, 1976, now abandoned.

The present application is related to applicant's copending patent application entitled "Jet Powered Watercraft", which will issue Apr. 4, 1976, as U.S. Pat. No. 3,948,206. The referenced patent discloses a vehicle or watercraft with which the present water ski is particularly adapted to operate. The watercraft is a twin-ski, jet-driven vehicle having a front ski located below and in spaced relation to the vehicle hull to support the vehicle. The vehicle is steered by rotation of the front ski about an upwardly and rearwardly inclined steering axis.

The water ski of the present invention is an improvement over the aforementioned ski of the prior art and provides improved operating characteristics, and with less frontal drag. However, use of the present invention is not confined to that particular vehicle, but instead it is useful in a variety of ski applications, as will become apparent. Reference to the applicant's U.S. Pat. No. 3,948,206 is merely exemplary and made only by way of background.

BACKGROUND OF THE INVENTION

1. Field of the Invention

The present invention relates to a water ski, and particularly to a water ski of the type having depending, laterally spaced side sections.

2. Description of the Prior Art

It is well known in the art to provide a ski having a generally planar central section and a pair of depending side sections to reduce skidding of the ski and otherwise improve its efficiency and stability. Preferably, the side sections do not develop any appreciable frontal drag, that is, no significant differential water pressure against the opposite faces of each side section. The inverted U-shape or channel-like tunnel defined by the center and side sections of the ski should be configured such that the drag is primarily a surface or skin drag.

In the front ski of the referenced patent the depending, generally planar side sections were joined to the planar central section along juncture or intersection lines that were more or less parallel so that the channel or "tunnel" through which the water passed would present surfaces that were equidistant throughout their length. It was believed that this would essentially eliminate frontal drag so that the side sections would desirably function solely to control or stabilize lateral slippage of the ski and vertical or up and down movement of the ski. However, although this configuration was found to operate successfully, an unexpectedly significant frontal drag was experienced and it was also found that the watercraft did not respond as sensitively and rapidly to the steering effect of the front ski as had been expected.

SUMMARY OF THE INVENTION

According to the present invention, a water ski is provided comprising an elongated central section defining a planing surface, and a pair of side sections depending from the center section to define downwardly and laterally inclined side surfaces lying generally in a pair of planes intersecting the planing surface and meeting along a line located above the planing surface.

The pair of juncture or intersection lines between the inner surfaces and the planing surface are characteristically laterally divergent in a downstream direction when the water ski is viewed from above. When viewed from an upstream direction, with the planing surface tipped at the predetermined planing or trim angle, the side surfaces are equidistant from one another where they are intersected by a horizontal plane. Thus, when planing over the water, the ski side surfaces at the horizontal plane of the water surface present a passage whose walls are equidistant from one end to the other whereby minimum frontal drag is developed.

With reference to the front ski previously mentioned, in which the side portions were joined to the center section along parallel lines, it was found that when such a structure was tipped upwardly to the normal trim angle at which the ski planes, the downstream extremities of the side sections presented a convergent path or "tunnel" to the water, which developed the undesirable frontal drag previously mentioned. With the present ski, the side sections are uniformly spaced apart in any horizontal plane, with the ski oriented in its predetermined or operative trim angle, despite the apparent rearward divergence, when viewed from above, of the juncture lines between the planing surface and the side surfaces.

Other objects and features of the present invention will become apparent from consideration of the following detailed description when taken in conjunction with the accompanying drawings.

BRIEF DESCRIPTION OF THE DRAWINGS

FIG. 1 is a perspective view of a water vehicle utilizing the water ski of the present invention;

FIG. 2 is an enlarged top plan view of the ski of FIG. 1;

FIG. 3 is a left side elevational view of the ski;

FIG. 4 is a front elevational view of the ski, with the ski disposed at its operative or predetermined trim angle;

FIG. 5 is a diagrammatic showing of the disposition of the ski side sections in inclined planes, when the center section is inclined at the operating trim angle;

FIG. 6 is a top plan view of a water ski of the prior art; and

FIG. 7 is a front elevational view of the ski of FIG. 6 as the same would appear when inclined upwardly at its forward end into its normal planing or trim angle.

DESCRIPTION OF THE PREFERRED EMBODIMENT

According to the present invention, there is illustrated in FIGS. 2–5 a water ski 10, which is particularly adapted for use in association with the watercraft shown in my U.S. Pat. No 3,948,206, and which is shown generally in FIG. 1. This watercraft comprises an elongated hull 12, a front ski assembly 14, a rear ski assembly 16, and a jet pump 18 adapted to accelerate and discharge water at high velocity to propel the watercraft forwardly.

The front ski assembly 14 includes a front ski 10 located below and in spaced relation to the forward end of the hull 12, a strut, a pair of parallelogram links 20 each pivotally attached at one end to the strut 19, and a support 22 pivotally secured to the opposite ends of the links 20 and rigidly secured at its base to the ski 10.

Handle bars 24 on the watercraft are operative to pivot the ski 10 about a downwardly and forwardly inclined steering axis defined by the strut 19 to steer the watercraft through the water.

The front and rear ski assemblies 14 and 16 are operative to hydrodynamically lift the watercraft from a displacement position to a planing position in which the front ski 10 is upwardly inclined. In this position, the planing surface of the ski 10 is disposed at a predetermined planing or trim angle which develops sufficient lift, along with the rear ski, to maintain the watercraft in planing position under normal conditions of propulsion or thrust. The trim angle has been found to be approximately four degrees, relative to the horizontal plane 25 of the water surface, in one embodiment of the watercraft, although it will be apparent that this figure is merely exemplary.

Referring now in detail to the water ski 10 of the present invention, the water ski 10 comprises, generally, an elongated central section 26 and a pair of coextensive elongated side sections 28 depending from the central section 26. The sections 26 and 28 are preferably made or corrosion-resistant metal plates which are cut to the proper configuration and welded or otherwise secured together.

The central section 26 is generally planar, although it preferably has a slight curvature or convexity, as best seen in FIG. 3, to smoothly negotiate the water surface during planing. The underside of the section 26 defines a planing surface 30 normally disposed at a predetermined trim angle 32 of approximately four degrees relative to the horizontal plane 25 of the water surface. As previously indicated, the trim angle will vary with the particular application involved, as will be apparent.

The side sections 28 are also generally planar and define downwardly and outwardly or laterally inclined outer side surfaces and inner side surfaces 34, the surfaces 34 lying generally in a pair of planes 36, as best seen in FIG. 5. The planes 36 intersect each other along a line located above the planing surface 30. In addition, the planes 36 of the side surfaces 34 also intersect the general plane of the planing surface 30 along a pair of lines 38, as indicated generally in FIGS. 2 and 5.

As best seen in FIG. 2, these juncture lines 38 are laterally divergent in a downstream direction, when viewed from above, and with the planing surface 30 at its trim angle. That is, the transverse distance between the lines 38 at the forward or upstream end of the ski 10 is closer than the corresponding distance between the lines 38 at the rearward or downstream extremity of the ski 10. However, despite this apparent divergence of the side surfaces 34 defining the side walls of the water passage beneath the ski, the side surfaces 34 do not diverge in the upwardly tipped or trim angle position of the ski 10, as seen in FIG. 4.

More particularly, in this position, and as seen from an upstream position, any confronting or oppositely located side surface points 40 lying in any horizontal plane 25 cutting the two side surfaces 34 are laterally spaced apart approximately the same distance. This is true throughout the length of the water passage or tunnel beneath the planing surface 30. Stated another way, wherever the horizontal plane 25 of the water surface meets the side surfaces 34, the confronting portions of the surfaces 34 will be equidistant along the lengths of the surfaces 34. Consequently, there is no significant frontal drag. The prior art ski structure **10*a* is illustrated in FIGS. 6 and 7 to show the difference between it and that of the ski 10 of the present invention. In this disclosure, the elements of the prior art ski 10*a* which correspond generally to the elements of the ski 10** will be assigned the subscript "*a*".

The planing surface **30*a* of the central section 26*a* is intersected by the pair of planes 36*a* of the downwardly and laterally inclined side sections 28*a* along a pair of juncture or intersection lines, as indicated at 38*a*. These lines are parallel when viewed from above the ski 10, indicating that the side surfaces 34*a*** are equidistant.

When the ski **10*a* is inclined upwardly at its upstream end to dispose the planing surface 30*a* at the operating trim angle, as seen in FIG. 7, the horizontal plane of the water surface 25 cuts or intersects the side surfaces 34*a* such that the width of the water passage at the water surface between the surfaces 34*a* narrows in a downstream direction. This develops frontal drag and also produces undesirable understeering, a condition in which it is difficult to initiate a turn, and also undesirable oversteering, a condition in which it is difficult to halt a turn once it is initiated. Thus, although one would expect that the ski 10*a* would be characterized by insignificant frontal drag because of the equidistant spacing between the side surfaces 34*a***, this did not prove to be the case.

In contrast, ski 10 employs rearwardly divergent side surfaces 34 which, when the planing surface 30 is tilted to its operative trim angle, are equidistant in the horizontal plane of the water surface.

While a particular presently preferred embodiment of the water ski of the present invention has been described in detail above, it should be appreciated that numerous other configurations utilizing the principles of the invention may be constructed. Therefore, the invention is not to be limited, except by the following claims.

I claim:

1. A water ski comprising:

an elongated central section having an underside defining a planing surface adapted to plane across the water at a predetermined acute trim angle relative to a horizontal plane corresponding to the water surface; and a pair of elongated side plates depending from said central section and having downwardly and laterally inclined inner side surfaces lying generally in a pair of planes intersecting above said planing surface, the pair of juncture lines between said pair of side surfaces and said planing surface being laterally divergent in a downstream direction when viewed from above, said side plates further having downwardly and laterally directed outer side surfaces, both said inner side surfaces and said outer side surfaces being adapted to be normally contacted by the water upon passage of said plates through the water.

2. A water ski according to claim 1 wherein said central section is generally planar.

3. A water ski according to claim 1 wherein, when viewed from an upstream direction with said planing surface at said predetermined trim angle relative to a horizontal plane, oppositely located points in said side surfaces disposed in a horizontal plane are laterally spaced apart approximately the same distance as all other oppositely located points in the same horizontal plane.

4. A water ski comprising:

an elongated central section having an underside defining a planing surface adapted to plane across the water at a predetermined acute trim angle relative to a horizontal plane corresponding to the water surface; and a pair of elongated side plates depending from said central section and having downwardly and laterally inclined inner side surfaces lying generally in a pair of planes, said pair of planes being equidistant in said horizontal plane when said planing surface is disposed at said trim angle, said side plates further having downwardly and laterally directed outer side surfaces whereby, when said planing surface is disposed at said trim angle, said horizontal plane intersects each of said side plates at waterlines which are parallel.

* * * * *